US007834836B2

(12) United States Patent
Chung et al.

(10) Patent No.: US 7,834,836 B2
(45) Date of Patent: Nov. 16, 2010

(54) FLAT DISPLAY APPARATUS AND PICTURE QUALITY CONTROLLING METHOD THEREOF

(75) Inventors: In Jae Chung, Gyeonggi-do (KR); Chul Sang Jang, Gyeonggi-do (KR); Sung Hak Jo, Gyeonggi-do (KR); Deuk Su Lee, Gyeonggi-do (KR); Jong Hoon Kim, Gyeonggi-do (KR); Jong Hee Hwang, Geonggi-do (KR)

(73) Assignee: LG Display Co., Ltd., Seoul (KR)

( * ) Notice: Subject to any disclaimer, the term of this patent is extended or adjusted under 35 U.S.C. 154(b) by 863 days.

(21) Appl. No.: 11/477,386

(22) Filed: Jun. 30, 2006

(65) Prior Publication Data

US 2007/0085790 A1 Apr. 19, 2007

(30) Foreign Application Priority Data

Oct. 17, 2005 (KR) ..... 10-2005-0097618

(51) Int. Cl.
*G09G 3/36* (2006.01)

(52) U.S. Cl. ..... 345/89; 345/88; 345/690; 345/214

(58) Field of Classification Search ..... 345/76–78, 345/87–99, 207, 690, 214; 348/180–194
See application file for complete search history.

(56) References Cited

U.S. PATENT DOCUMENTS 6,603,452 B1 * 8/2003 Serita ..... 345/88
6,704,008 B2 * 3/2004 Naito et al. ..... 345/207
6,847,342 B2 * 1/2005 Tsuji ..... 345/82
6,946,886 B2 * 9/2005 Isomura ..... 327/141
7,009,627 B2 * 3/2006 Abe et al. ..... 345/690
2002/0067326 A1 * 6/2002 Aoki ..... 345/89
2003/0098839 A1 * 5/2003 Lee ..... 345/89
2005/0062735 A1 * 3/2005 Kim ..... 345/204
2005/0093798 A1 * 5/2005 Kamada et al. ..... 345/89
2005/0116917 A1 * 6/2005 Aoki ..... 345/99
2005/0140622 A1 * 6/2005 Lee et al. ..... 345/88

FOREIGN PATENT DOCUMENTS

| | | |
|---|---|---|
| JP | 07-261710 | 10/1995 |
| JP | 2001-231053 | 8/2001 |
| JP | 2001-331156 | 11/2001 |
| JP | 2002-366109 | 12/2002 |
| JP | 2004-062134 | 2/2004 |
| JP | 2004-153532 | 5/2004 |
| JP | 2004-177827 | 6/2004 |
| JP | 2005-134864 | 5/2005 |

* cited by examiner

*Primary Examiner*—Amare Mengistu
*Assistant Examiner*—Hong Zhou
(74) *Attorney, Agent, or Firm*—Morgan Lewis & Bockius LLP

(57) ABSTRACT

A flat panel display device includes a display panel, a memory storing a compensation value that corresponds to a panel defect location, the panel defect location being where any one of a brightness and a color difference exists compared to other part of the display panel, a compensating unit to adjust image data to be displayed in the panel defect location using the compensation value, and a driver to apply the adjusted image data from the compensating unit to the display panel.

22 Claims, 14 Drawing Sheets

FLAT DISPLAY APPARATUS AND PICTURE QUALITY CONTROLLING METHOD THEREOF

This application claims the benefit of the Korean Patent Application No. P2005-97618 filed in Korea on Oct. 17, 2005, which is hereby incorporated by reference.

BACKGROUND OF THE INVENTION

1. Field of the Invention

The present invention relates to a display device, and more particularly, to a flat panel display device, and a picture quality controlling method thereof, that improves picture quality by electrically compensating for panel defects.

2. Discussion of the Related Art

Recently, there has been an increase in development of various flat panel display devices with decreased weight and size, both of which are disadvantages in cathode ray tube display devices. The flat panel display devices include liquid crystal display devices, field emission display devices, plasma display panels, organic light emitting diode devices, and the like.

Generally, the flat panel display devices include a display panel for displaying a picture. During testing, panel defects, or mura defects, has been found in such display panels. For instance, the discovered panel defects include defects such as a display spot accompanying difference in brightness on a display screen. The panel defects are mostly generated during a fabricating process. Some of the defects may have a fixed shape, such as dot, line, belt, circle, polygon, or the like. Other defects may have an unspecified shape.

Examples of various panel defects are shown in FIGS. 1 to 3. FIG. 1 shows a panel defect of unspecified shape, FIG. 2 shows a panel defect having a vertical bar shape, and FIG. 3 shows a panel defect having a dot shape. The panel defect having vertical stripes is mainly caused by overlapping exposure, a difference in the number of lenses, and the like. The panel defect having dots is mainly caused by impurities. Images displayed in the location of such defects appear darker or brighter than an ambient non-defect area. Color difference is also perceivable when compared with the non-defect area.

The panel defects may degrade the final product to a certain degree, lowering product yield, and ultimately leading to increased cost. Further, even if the product with the panel defect is shipped as a good product, the deteriorated picture quality due to the panel defect reduces product reliability.

Accordingly, various methods have been proposed to reduce the panel defect. However, methods of the related art to reduce the problem are mainly directed to solving problems in the fabrication process. Disadvantages of such methods include difficulties in properly dealing with the panel defects generated in the improved process.

SUMMARY OF THE INVENTION

Accordingly, the present invention is directed to a flat panel apparatus, and picture quality controlling method thereof, that substantially obviates one or more problems due to limitations and disadvantages of the related art.

An object of the present invention is to provide a flat panel display device, and a picture quality controlling method thereof, that improves picture quality by electrically compensating for a panel defect.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat panel display device includes a display panel, a memory storing a compensation value that corresponds to a panel defect location, the panel defect location being where any one of a brightness and a color difference exists compared to other part of the display panel, a compensating unit to adjust image data to be displayed in the panel defect location using the compensation value, and a driver to apply the adjusted image data from the compensating unit to the display panel.

In another aspect, a method of controlling a picture quality of a flat panel display device includes the steps of analyzing a display panel to determine a panel defect location, the panel defect location being where any one of a brightness and a color difference exist compared to other parts of the display panel, determining a compensation value corresponding to the panel defect location, detecting image data to be displayed in the panel defect location, adjusting the image data using the compensation value, and displaying the adjusted image data on the display panel.

In yet another aspect, a driving circuit for displaying an image on a flat panel display device includes a memory storing at least one compensation value that corresponds to a panel defect location, the panel defect location being where any one of a brightness and a color difference exists compared to other part of a display panel, and a compensating unit to adjust image data to be displayed in the panel defect location using the compensation value.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
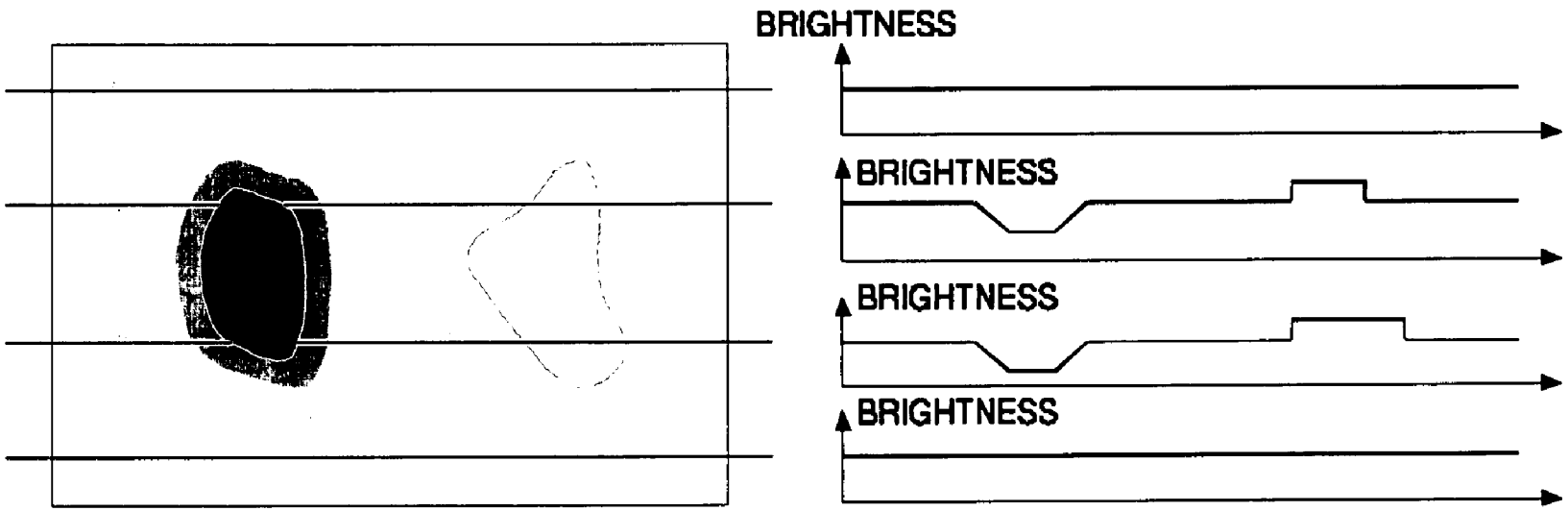
FIG. 1 RELATED ART
FIG. 1 is a view representing a panel defect of unspecified shape in the related art.
Figure 2:
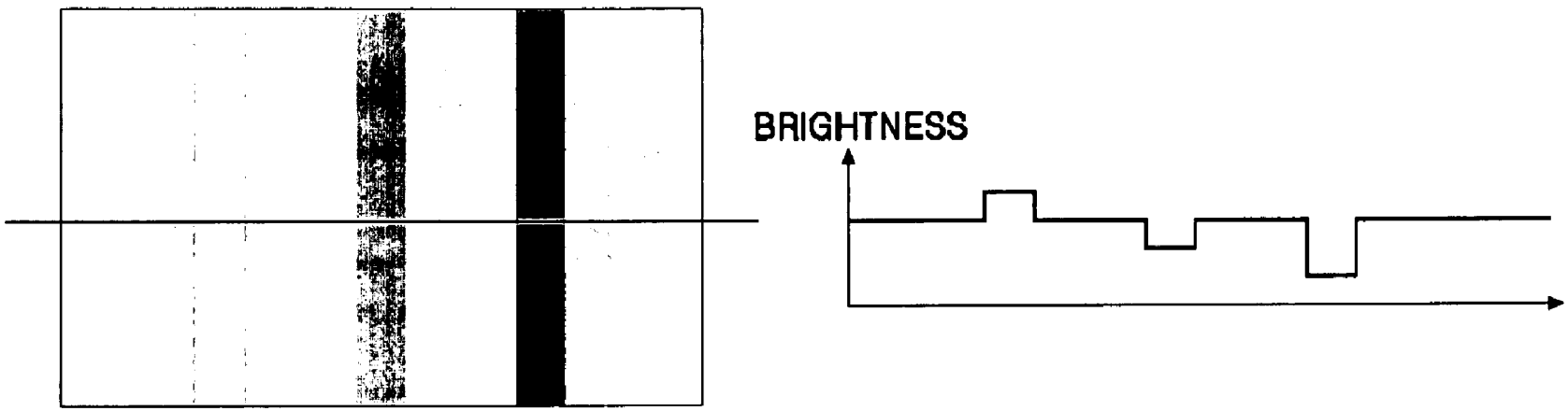
FIG. 2 RELATED ART
FIG. 2 is a view representing a panel defect of vertical bar shape in the related art.
Figure 3:
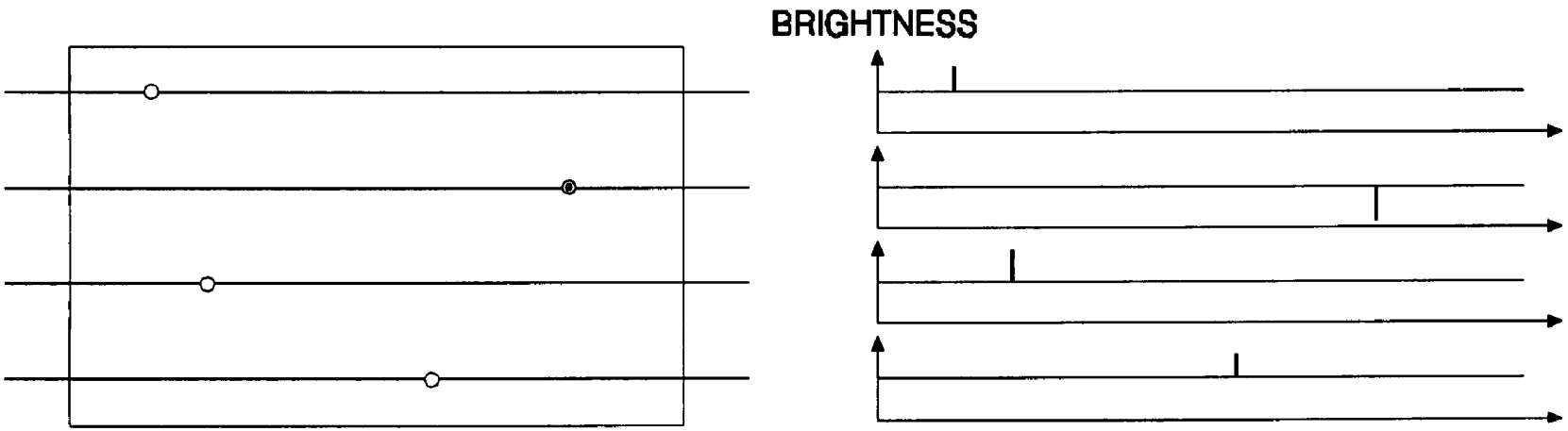
FIG.3 RELATED ART
FIG. 3 is a view representing a panel defect of dot shape in the related art.
Figure 4:
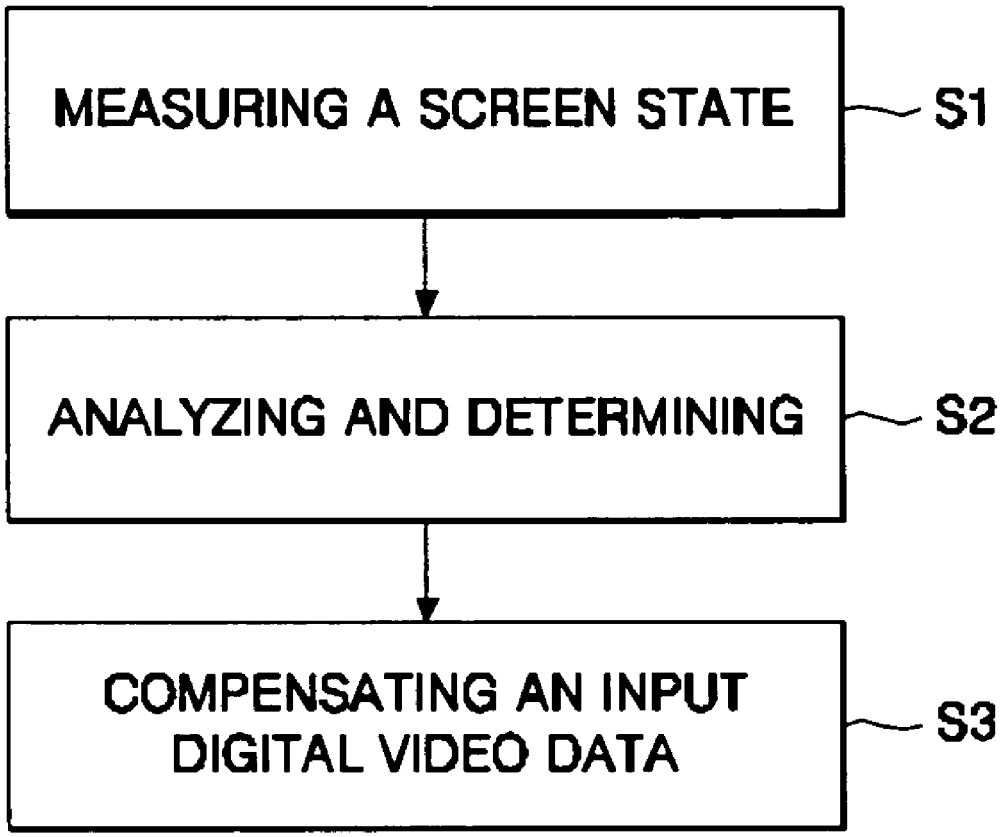
FIG. 4 is a block diagram of an exemplary panel defect compensation method according to the present invention.

FIG. 4 shows a picture quality controlling method of a flat panel display device according to an exemplary embodiment of the present invention. As shown in FIG. 4, the picture quality controlling method of the flat panel display device according to an exemplary embodiment of the present invention measures a screen state after applying an input signal to a sample flat panel display device using measuring equipment, such as a camera or the like. (S1)

In step S1, the image displayed on the sample flat panel display device is measured with measuring equipment, such as a camera or the like, having a resolution higher than the sample flat panel display device while increasing the input signal of the sample flat panel display device by one gray level starting from the lowest gray level (black) to the highest gray level (white). As an example, an input signal of 8 bits, for example, for each of RGB signals is received while a total of 256 screens from 0 to 255 gray level is measured for a sample flat panel display device having a resolution of 1366×768, for example. Accordingly, each of the measured screens should have a resolution of 1366×768 or more, and the brightness should have the resolution of at least 8 bits or more, based on this example.

By analyzing the measured results, the picture quality controlling method of the flat panel display device according to the exemplary embodiment of the present invention judges the presence or absence of the panel defects. If the panel defects are detected in the sample flat panel display device, a compensation value to correct the brightness and/or color difference of the panel defect is established. (S2) The input video data is then modulated with the compensation value to compensate for the brightness and/or color difference at the panel defect location. (S3)

In the step S2, the location and degree of the panel defect for each gray level are determined from the measured results of step S, and the compensation value is determined therefrom. The compensation value is optimized for each location since the degree of unevenness in brightness and/or color difference may be different for each location of the panel defect. Additionally, the compensation value is optimized for each gray level in consideration of gamma characteristics.

Figure 5:
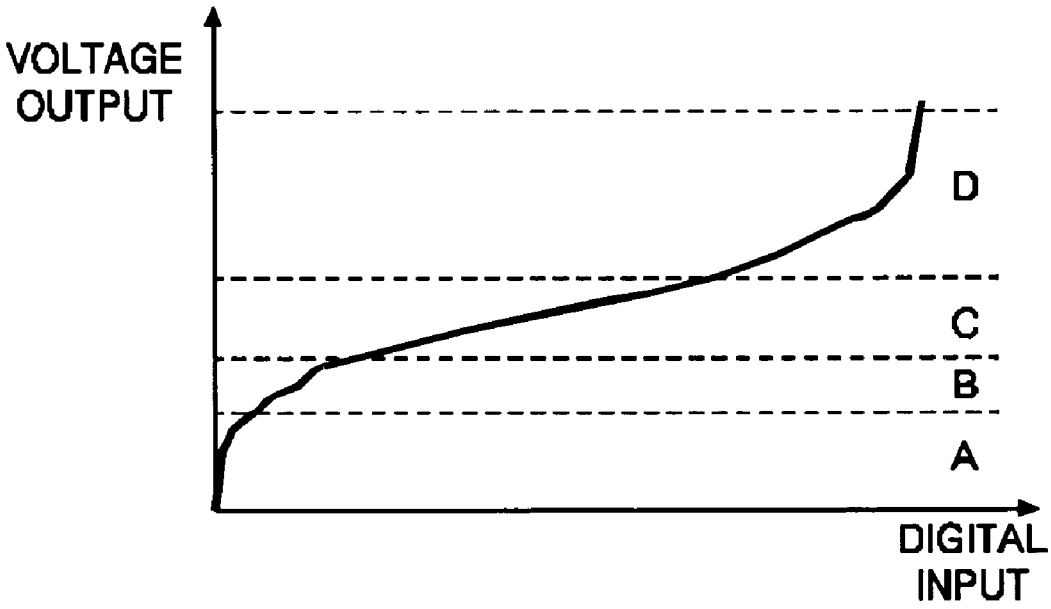
FIG. 5 is a graph representing a gamma characteristic according to an exemplary embodiment of the present invention.

As shown in FIG. 5, the compensation value can be set for each gray level or for each gray level section (A, B, C, D), which includes a plurality of gray levels. For example, a compensation value may be set for each gray level in the following exemplary manner: "+1" may be set in the location of "panel defect 1," "−1" may be set in the location of "panel defect 2," "0" may be set in the location of "panel defect 3," and so on. Alternatively, the compensation value may be set for each gray level section in the following exemplary manner: "0" in "gray level section A," "0" in "gray level section B," "1" in "gray level section C," "1" in "gray level section D," and so on. Accordingly, the compensation value can be made different in the same panel defect location for each gray level and can also be different in the same gray level for each panel defect location.

When correcting for difference in brightness, the compensation values are set to be the same value in each of R, G, B data of one pixel. Thus, the compensation values are set for each pixel inclusive of R, G, B sub-pixels. When correcting for difference in color, the compensation value is set differently for each of the R, G, B data. For example, if the red color appears more conspicuous in a specific panel defect location than in the non-defect location, an R compensation value may be set to be smaller than G, B compensation values. The compensation values may be arranged in a lookup table along with the panel defect location data and stored in a non-volatile memory.

To correct for the panel defects, the compensation values established in step S2 are selectively added to or subtracted from the input digital video data to be displayed at the panel defect location, thereby modulating the corresponding digital video data. (S3) To describe the compensation step in detail, in step S3, the display location and gray level of the input digital video data are analyzed and a display spot is compensated by adding to or subtracting from the input digital video data a pre-set compensation value if the input digital video data is judged to be the data which is to be displayed in the panel defect location.

For example, a display location of the input digital video data is compared with the panel defect location stored in the non-volatile memory. If the comparison determines that the display location for the input digital video data is a panel defect location, the compensation value stored for the location in the non-volatile memory is applied to the input digital video data. For example, if the compensation value according to the gray level of the panel defect location is set as "2," the display spot is compensated by adding a "2" to the input digital video data the compensation to increase the input digital video data to be displayed at the panel defect location by two gray levels. On the other hand, if the compensation value according to the gray level at the panel defect location is set as "−2," the display spot is compensated by adding "−2" to the input digital video data to be displayed in the panel defect location to decrease the input digital video data to be displayed at the panel defect location by two gray levels.

Figure 6:
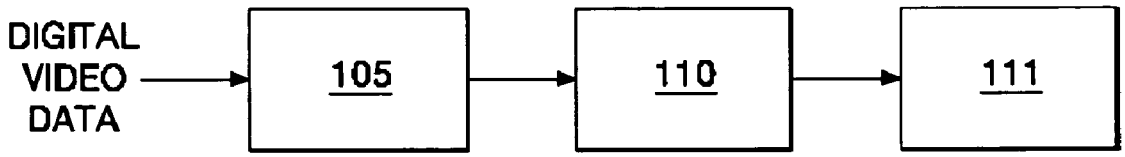
FIG. 6 is a block diagram of a flat panel display device according to an exemplary embodiment of the present invention.

As shown in FIG. 6, the flat panel display device according to an exemplary embodiment of the present invention includes a compensation circuit 105 that receives the video data, modulates the video data, and then supplies the modulated video data to a driving part 110 of a display panel 103. More specifically, FIG. 7 shows a liquid crystal display device according to an exemplary embodiment of the present invention.

Figure 7:
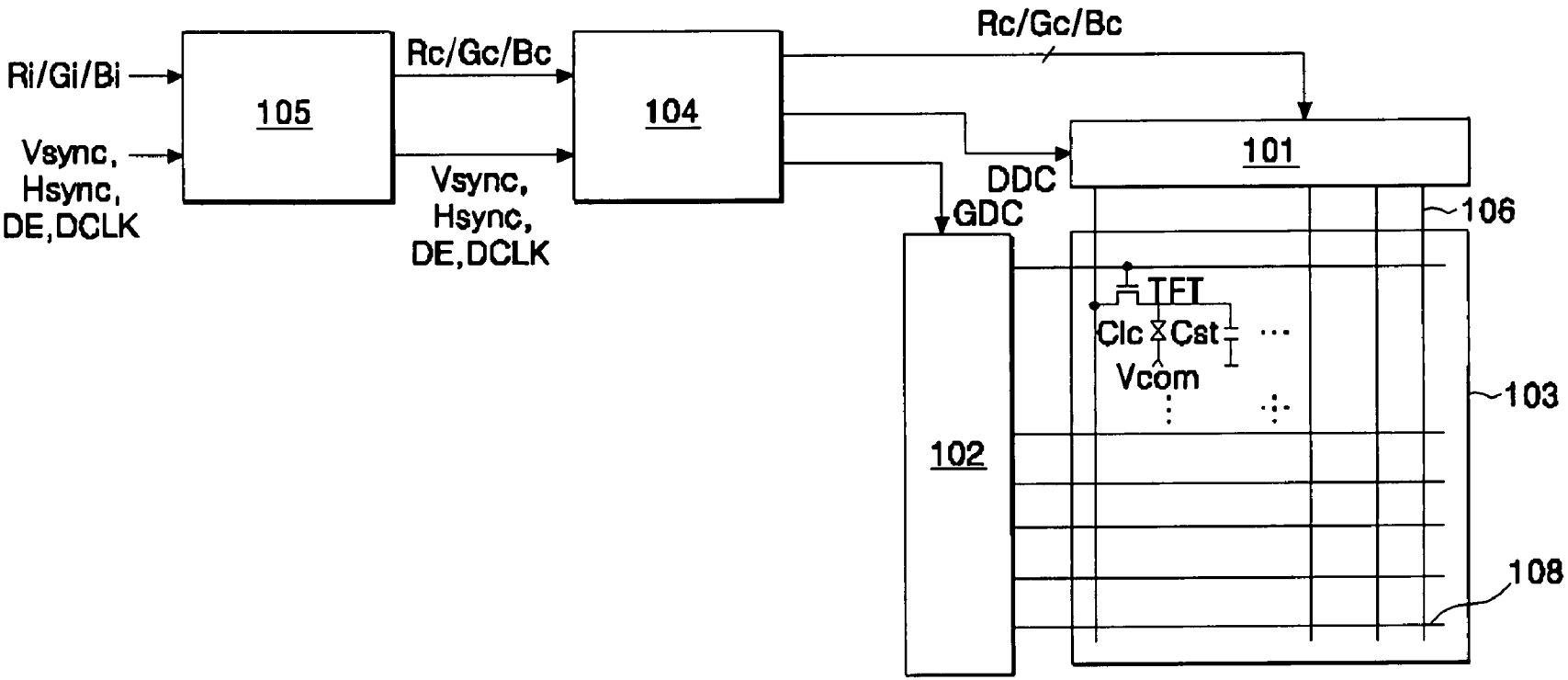
FIG. 7 is a block diagram of a liquid crystal display device according to an exemplary embodiment of the present invention.

As shown in FIG. 7, the liquid crystal display device according to an exemplary embodiment of the present invention includes a liquid crystal display panel 103 having data lines 106 cross gate lines 108 with a thin-film transistor (TFT) formed at each intersection to drive a liquid crystal cell (Clc). Further, a compensation circuit 105 to generate a corrected digital video data Rc/Gc/Bc, a data drive circuit 101 to supply the data line 106 with the corrected digital video data Rc/Gc/Bc, a gate drive circuit 102 to supply a scan pulse to the gate lines 108, and a timing controller 104 to control the data drive circuit 101 and the gate drive circuit 102 are also included.

The liquid crystal display panel 103 includes two substrates, typically a TFT substrate and a color filter substrate, with liquid crystal molecules injected between the two substrates. The data lines 106 and the gate lines 108 are typically formed on the TFT substrate cross and each other. The TFTs formed at the crossing parts of the data lines 106 and the gate lines 108 supply an analog gamma compensation voltage supplied through the data line 106 to a pixel electrode (not shown) of the liquid crystal cell Clc in response to a scan signal from the gate line 108. Typically, a black matrix, a color filter, and a common electrode (not shown) are formed on the color filter substrate. One pixel on the liquid crystal display panel 103 includes a red (R) sub-pixel, a green (G) sub-pixel, and a blue (B) sub-pixel. The common electrode formed on the color filter substrate may alternatively be formed on the TFT substrate depending on an electric field application method. Polarizers having vertical polarizing axes and perpendicular to each other are respectively attached to the TFT substrate and the color filter substrate.

The compensation circuit 105 receives the input digital video data Ri/Gi/Bi from a system interface to modulate the input digital video data Ri/Gi/Bi, which are to be supplied to the panel defect location, to generate the corrected digital video data Rc/Gc/Bc. The compensation circuit 105 is described in more detailed below.

The timing controller 104 generates a gate control signal (GDC) to control the gate drive circuit 102 and a data control signal (DDC) to control the data drive circuit 101 based on a vertical synchronization signal (Vsync), a horizontal synchronization signal (Hsync), a data enable signal (DE), and a dot clock signal (DCLK) supplied through the compensation circuit 105. Further, the timing controller 104 supplies the corrected digital video data Rc/Gc/Bc to the data drive circuit 101 in accordance with the dot clock signal (DCLK).

The data drive circuit 101 receives the corrected digital video data Rc/Gc/Bc, converts the digital video data Rc/Gc/Bc into an analog gamma compensation voltage, and supplies the analog voltages to the data lines 106 of the liquid crystal display panel 103 under control of the timing controller 104 to drive each of the liquid crystal cells (Clc). The gate drive circuit 102 supplies a scan signal to the gate lines 108, thereby turning on the TFT's connected to the gate lines 108 to select the liquid crystal cells (Clc) of one horizontal line to which the analog gamma compensation voltage is to be supplied. The analog gamma compensation voltage generated from the data drive circuit 101 is synchronized with the scan pulse to be supplied to the liquid crystal cells (Clc) of the selected one horizontal line.

Figure 8:
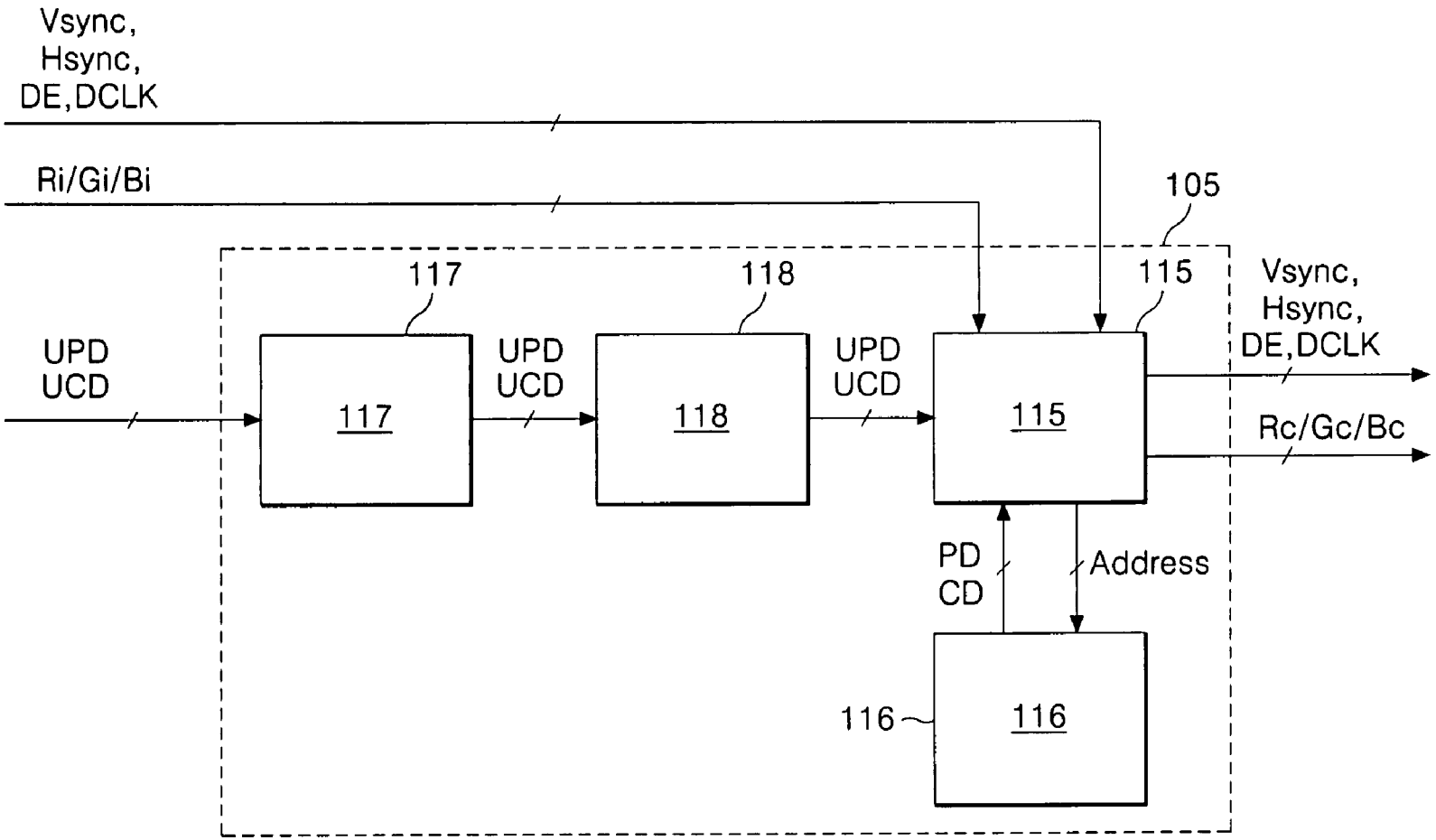
FIG. 8 is a block diagram of an exemplary compensation circuit of FIG. 7.

As shown in FIG. 8, the compensation circuit 105 includes a memory 116 in which the location and compensation value of a panel defect are stored, a modulator 115 to generate the corrected digital video data Rc, Gc, Bc by modulating the input signal Ri, Gi, Bi with the location and compensation value stored in the memory 116, an interface circuit 117 to communicate between the compensation circuit 105 and an external system, and a register 118 to temporarily store the location and compensation value of the panel defect that are to be stored at the memory 116. The compensation value in accordance with the gray level of the input digital video data Ri/Gi/Bi for each location of the panel defects are stored at the memory 116 along with the location of the panel defect. More specifically, the compensation value in accordance with the gray level may be a compensation value corresponding to each gray level, or the compensation value may be set in correspondence to a gray level section, which includes two or more gray levels.

Regarding the compensation value set corresponding to each gray level section, information for the gray level section, i.e., information of the gray level included in the gray level section, is also stored in the memory 116. The memory 116 may be a non-volatile memory. For example, the memory 11 may be an electrically erasable programmable read-only memory (EEPROM) with which the data for the compensation value and location of the panel defect may be updated by electrical signals from the external system. Alternatively, an extended display identification data read-only memory (EDID ROM) may be used as the memory 1116. The EDI ROM stores the panel defect compensation-related data in addition to monitor information data, such as seller/manufacturer identification information and variables, characteristics, and other data related to the display device. When EDID ROM is used, a ROM recorder (not shown) transfers the panel defect compensation data through a data display channel (DDC). Although the EEPROM and the EDID ROM are specifically mentioned as exemplary embodiments, other types of memory may be used without departing from the scope of the invention.

As shown in FIG. 8, the interface circuit 117 is configured to allow communication between the compensation circuit 105 and the external system (not shown) using a standard communication protocol, such as I2C, and the like. The external system (not shown) has access to the data stored in the memory 116 through the interface circuit 117 to read or modify the stored data. Accordingly, the compensation value data (CD) and the pixel location data (PD) of a panel defect stored in the memory 116 may be updated based on process changes, difference between application models, and the like. To this end, user-supplied compensation value data (UCD) and pixel location data (UPD) input from the external system (not shown) may be used to modify the data stored in the memory 116. However, other external data sources may be used without departing from the scope of the invention. The pixel location data (UPD) and compensation value data (UCD) transmitted through the interface circuit 117 are temporarily stored in the register 118 in order to update the memory 116.

The modulator 115 determines whether or not the input digital video data Ri/Bi/Gi are video data to be supplied to the location of the panel defect based on the information stored in the memory 116. If the modulator 115 determines that the input digital video data Ri/Bi/Gi are video data to be supplied to a panel defect location, the modulator 115 reads the compensation value of each gray level at the location of the panel defect from the memory 116 to generate the corrected digital video data Rc/Bc/Gc.

Figure 9:
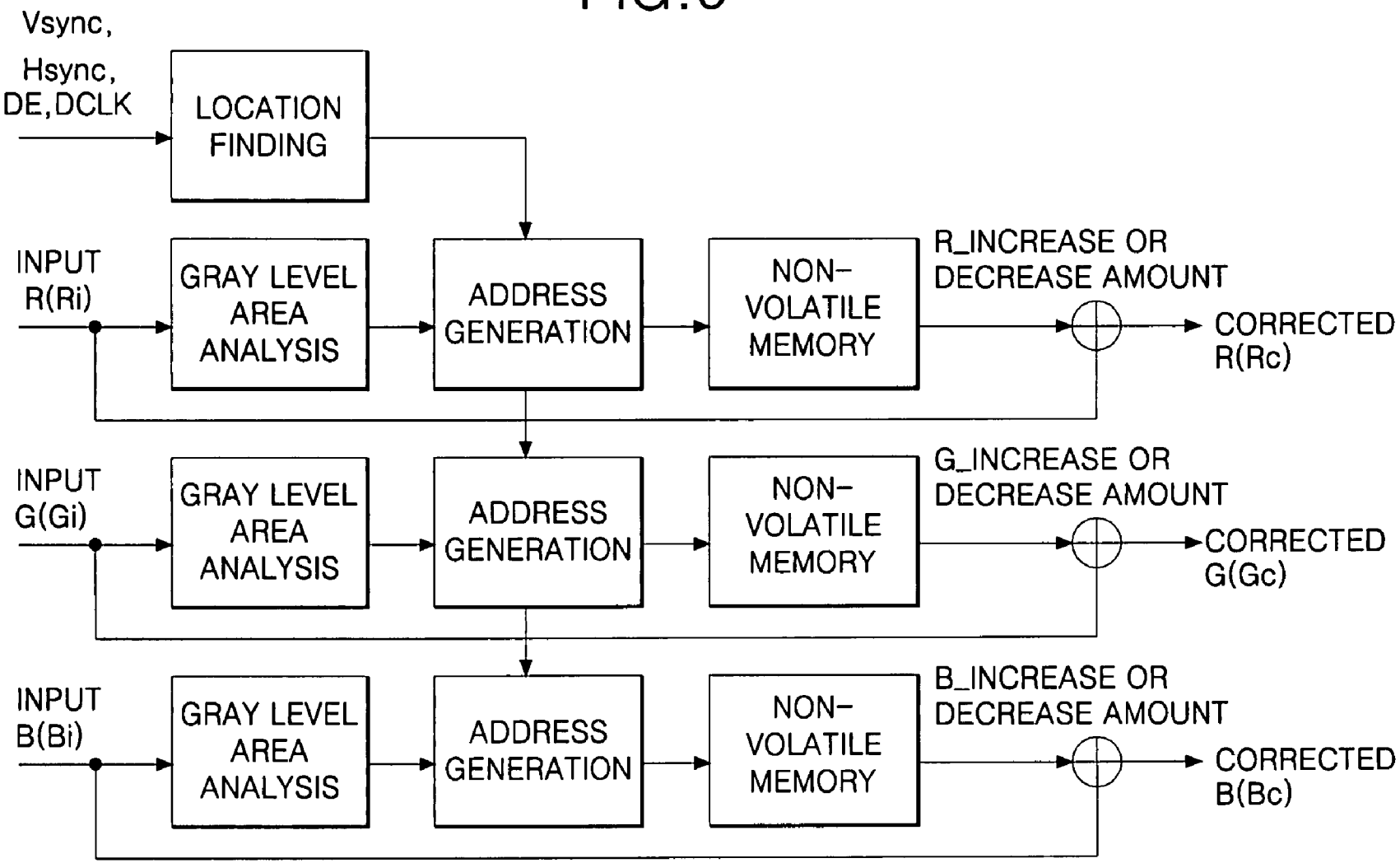
FIG. 9 is a block diagram of an exemplary panel defect compensation algorithm of a compensating part of FIG. 8.

The modulator 115 will be described with reference to FIG. 9. As shown in FIG. 9, the modulator 115 includes a location finding module to determine the location of the input digital video data Ri/Gi/Bi based on the vertical and horizontal synchronization signals (Vsync, Hsync), the data enable signal (DE), and the dot clock signal (DCLK). If the location of the input digital video data Ri/Gi/Bi corresponds to a panel defect location stored in the memory 116, the gray level area of the input digital video data Ri/Gi/Bi and the location data is analyzed to generate an address value for reading the compensation data from the memory 116. The compensation value data (R_increase/decrease amount, G_increase/decrease amount, B_increase/decrease amount) in accordance with the gray level of the input digital video data Ri/Gi/Bi at each location of the panel defect are stored at a specified address of the memory 116. Accordingly, the input digital video data Ri/Gi/Bi are increased or decreased in accordance with the compensation value data obtained from a specified address corresponding to the panel defect location to generate the corrected video data Rc/Gc/Bc.

Figure 10A:
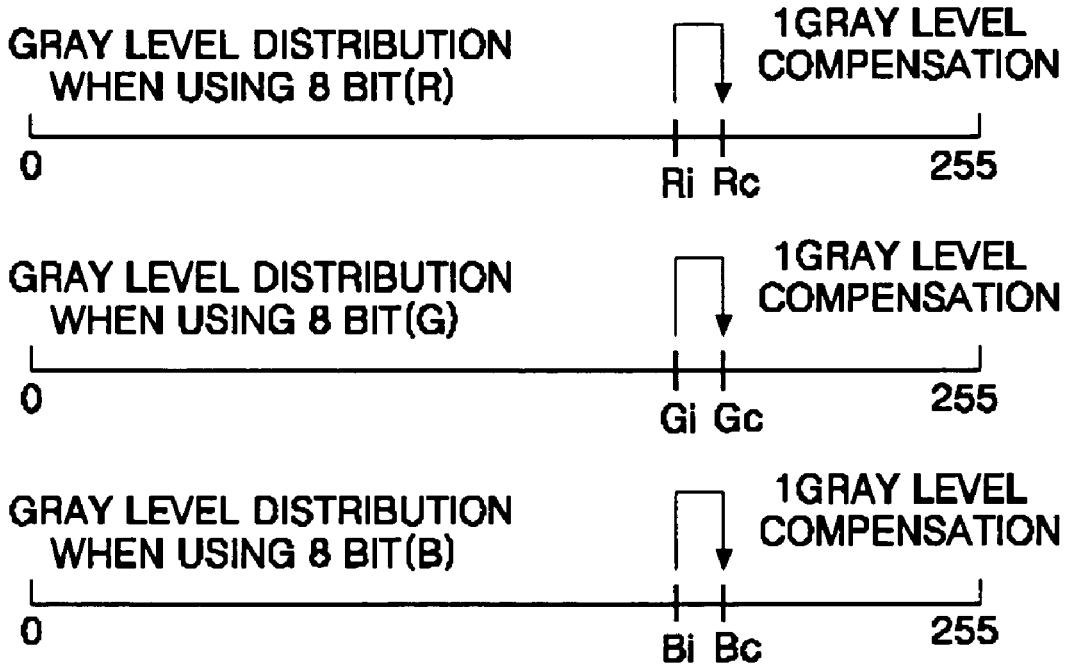
FIGS. 10A and 10B are views representing a gray level compensation example according to an exemplary embodiment of the present invention.
Figure 10B:
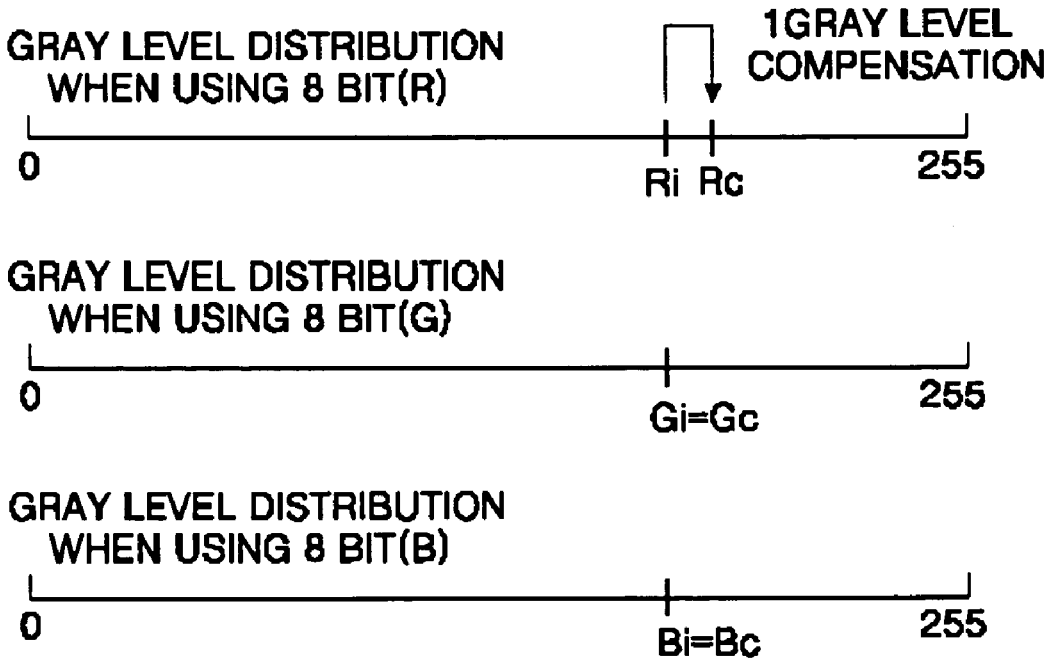

The compensation value data (R_increase/decrease amount, G_increase/decrease amount, B_increase/decrease amount) for one pixel in the same panel defect location and the same gray level may be set to be the same (i.e., an R compensation value for compensating red data, a G compensation value for compensating green data, and B compensation value for compensating blue data are all the same), or at least any one of the R compensation value, the G compensation value, and the B compensation value may be set to be different from the others depending on the correction needed at the panel defect location. For example, as shown in FIG. 10A, all three compensation values (i.e., R compensation value, G compensation value, B compensation value) are set to increase the respective input digital video data Ri, Gi, Bi by one gray level. Accordingly, all three colors (R, G, B) are equally increased in strength for this pixel location. Alternatively, as shown in FIG. 10B, a compensation value increased by one gray level is set as the R compensation value and a compensation value increased by zero gray level is set as the G compensation value and the B compensation value. That is to say, the R sub-pixel may be compensated with an increase of one gray level while no gray level compensation is made for the G sub-pixel and the B sub-pixel. Accordingly, the pixel with the R sub-pixel may be corrected to display a stronger red color. In this way, color correction may be made on a pixel-by-pixel basis.

Figure 11:
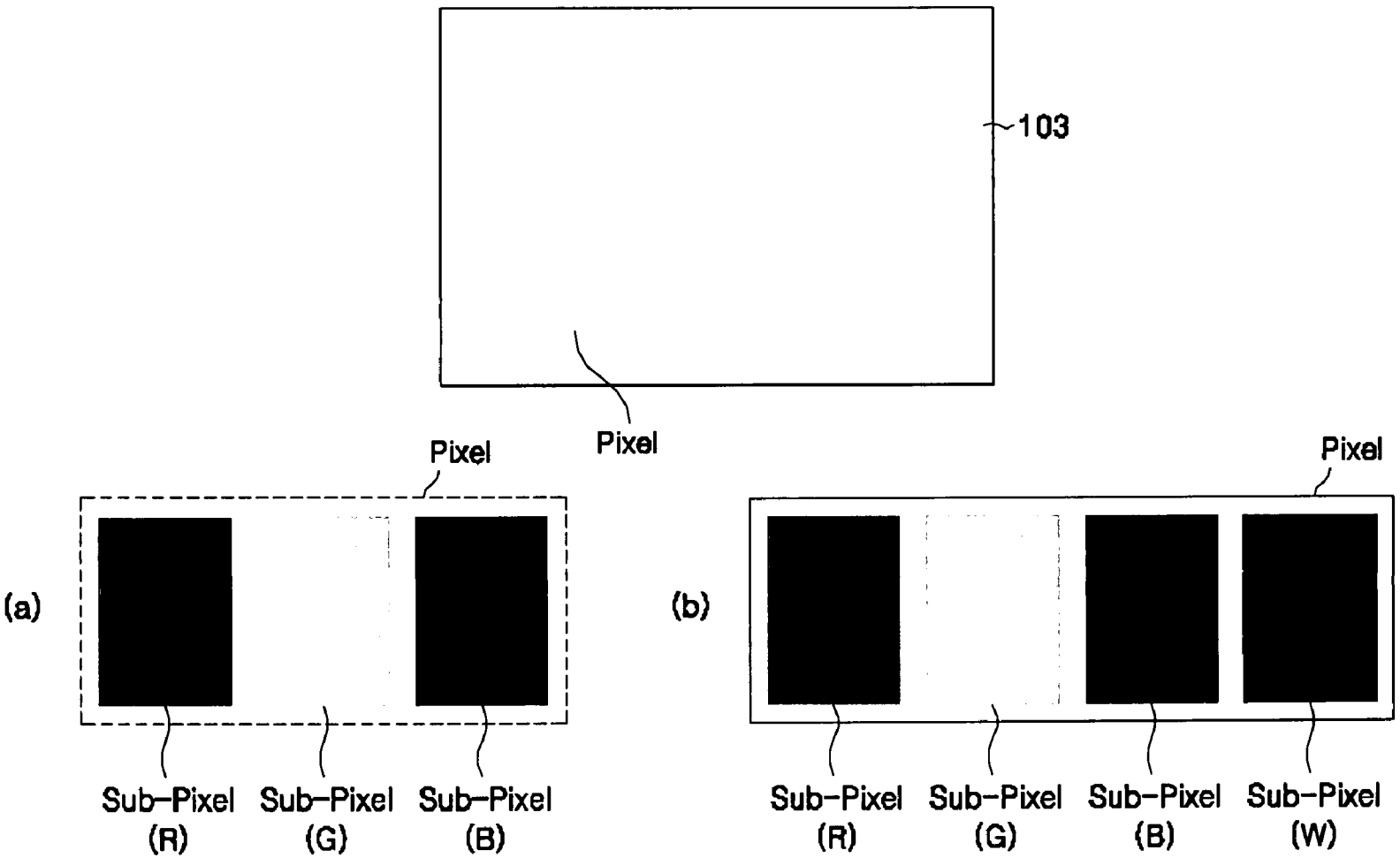
FIG. 11 is a diagram representing a pixel configuration example according to an exemplary embodiment of the present invention.
Figure 12:
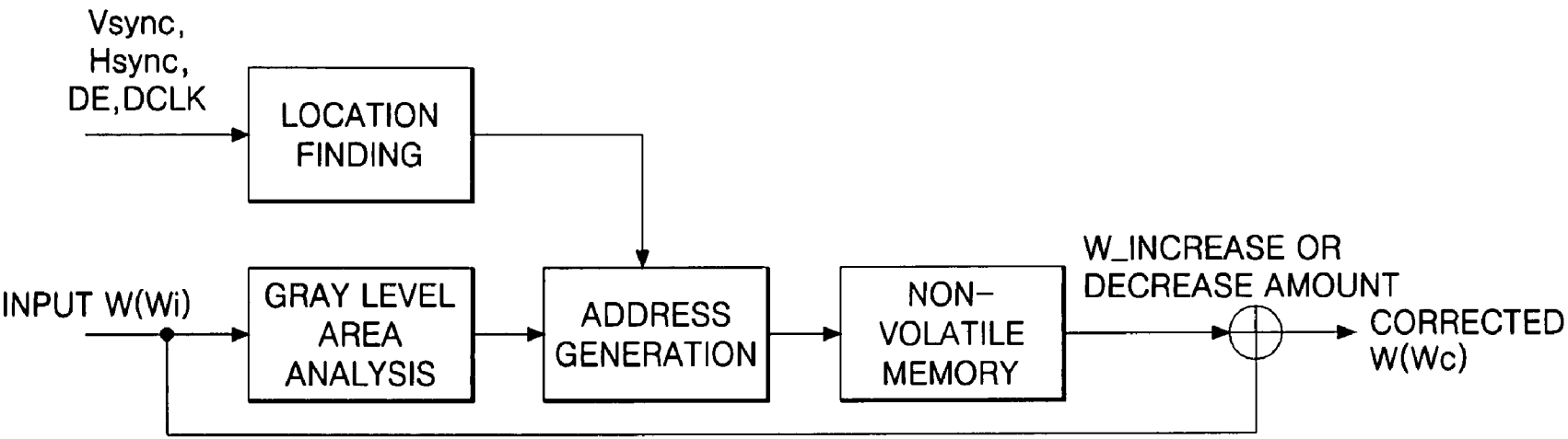
FIGS. 12 and 13 are block diagrams of a compensation example for R, G, B, W pixels according to an exemplary embodiment of the present invention.
Figure 13:
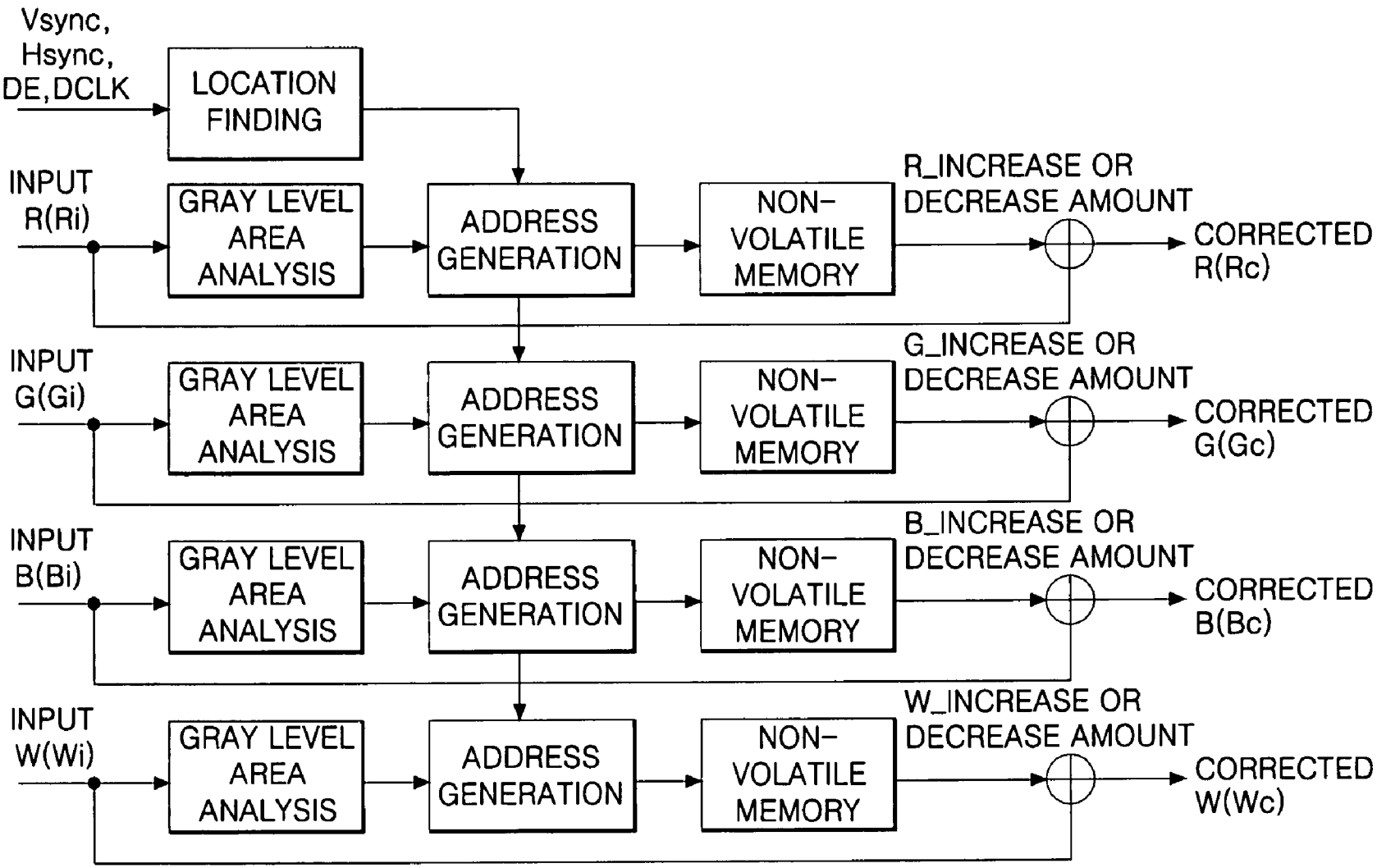

FIG. 11 shows a diagram representing various pixel configurations. A pixel is a minimum unit of a screen needed to display an image. In the case of a liquid crystal display panel 103, for example, a pixel may include three sub-pixels R, G, B (sub-pixel (R), sub-pixel (G), sub-pixel (B)) as shown in portion (a) of FIG. 11. Alternatively, a pixel may include four sub-pixels R, G, B, W (sub-pixel (R), sub-pixel (G), sub-pixel (B), sub-pixel (W)) with sub-pixel (W) expressing white, as shown in portion (b) of FIG. 11. When a pixel includes the R, G, B, W sub-pixels, gray level correction of a panel defect may be performed by compensating only the W sub-pixel, as shown in FIG. 12. If both gray level and color correction are needed, the gray level compensation and the color difference correction can be made at the same time by applying the compensation values to each of the R, G, B, W sub-pixels, as shown in FIG. 13.

As described above, the exemplary embodiment of the present invention has been described in relation to a liquid crystal display device. However, other flat panel display devices may be used without departing from the scope of the invention. Furthermore, the compensation circuit 105 as described above may be integrated with the timing controller 104 on a single chip. Other circuit arrangements may be used without departing from the scope of the present invention. As described above, the flat panel display device and the picture quality controlling method thereof according to the present invention electrically compensates for panel defects, and as a result, it is possible to improve the display quality in the display panel where the panel defect exists.

It will be apparent to those skilled in the art that various modifications and variations can be made in the flat display apparatus of the present invention and picture quality controlling method thereof without departing form the spirit or scope of the invention. Thus, it is intended that the present invention cover the modifications and variations of this invention provided they come within the scope of the appended claims and their equivalents.

What is claimed is:

1. A flat panel display device, comprising:

a display panel;

a memory storing a compensation value that corresponds to a panel defect location, the panel defect location being where any one of a brightness and a color difference exists compared to other part of the display panel under same conditions;

a compensating unit to adjust an image data to be displayed in the panel defect location using the compensation value;

a driver to apply the adjusted the image data from the compensating unit to the display panel, wherein the compensation unit includes;

an interface circuit communicating between the compensation unit and external system, a register storing the data transmitted through the interface circuit to update the memory, wherein the data are the pixel location data input from the external system and the compensation value supplied by user, a modulator reading the compensation value of each gray level at the location of the panel defect from the memory and generating the corrected data if the image data are to be supplied to the panel defect location, wherein the compensation value increases or decreases a gray level of the image data to be displayed at the panel defect location, wherein the compensation value includes an R compensation value for compensating red data, a G compensation value for compensating green data, and a B compensation value for compensating blue data, wherein the compensation value further includes a W compensation value for compensating white data, and wherein only the W compensation value is set to adjust the image data to be displayed in the panel defect location.

2. The flat panel display device according to claim 1, wherein the R compensation value, the G compensation value, and the B compensation value are set to be the same value in the same panel defect location.

3. The flat panel display device according to claim 1, wherein at least one of the R compensation value, the G compensation value, and the B compensation value is set to be different than the other compensation values in the same panel defect location.

4. The flat panel display device according to claim 1, wherein at least one of the R compensation value, the G compensation value, and the B compensation value is set to be different than the other compensation values in the same panel defect location.

5. The flat panel display device according to claim 1, wherein the memory includes a non-volatile memory.

6. The flat panel display device according to claim 5, wherein the non-volatile memory includes any one of an electrically erasable programmable read-only memory (EEPROM) and extended display identification data read-only memory (EDID ROM).

7. The flat panel display device according to claim 1, wherein the display panel includes a liquid crystal display panel having a plurality of data lines and a plurality of gate lines crossing each other and a plurality of liquid crystal cells, and the driver includes a data drive circuit to supply the adjusted image data to the data lines, a gate drive circuit to supply a scan pulse to the gate lines, and a timing controller to control the data and gate drive circuits and supply the adjusted image data to the data drive circuit.

8. The flat panel display device according to claim 7, wherein the compensating unit is integral with the timing controller.

9. A method of controlling a picture quality of a flat panel display device, comprising the steps of:

analyzing a display panel to determine a panel defect location, the panel defect location being where any one of a brightness and a color difference exist compared to other parts of the display panel under same conditions;

determining a compensation value corresponding to the panel defect location;

detecting image data to be displayed in the panel defect location;

adjusting the image data using the compensation value;

displaying the adjusted image data on the display panel, wherein the step of adjusting the image data using the compensation value includes; reading the compensation value of each gray level at the location of the panel defect from a memory, and generating the adjusted image data if the image data are to be supplied to the panel defect location, wherein the compensation value increases or decreases a gray level of the image data to be displayed at the panel defect location, wherein the compensation value includes an R compensation value for compensating red data, a G compensation value for compensating green data, and a B compensation value for compensating blue data, wherein the compensation value further includes a W compensation value for compensating white data, and wherein only the W compensation value is set to adjust the image data to be displayed in the panel defect location.

10. The method according to claim 9, wherein the R compensation value, the G compensation value, and the B compensation value are set to be the same value in the same panel defect location.

11. The method according to claim 9, wherein at least one of the R compensation value, the G compensation value, and the B compensation value is set to be different than the other compensation values in the same panel defect location.

12. The flat panel display device according to claim 9, wherein at least one of the R compensation value, the G compensation value, and the B compensation value is set to be different than the other compensation values in the same panel defect location.

13. The method according to claim 9, further includes the step of storing the determined compensation value in a memory such that an address of the memory corresponding to the panel defect location.

14. A driving circuit for displaying an image on a flat panel display device, comprising:

a memory storing at least one compensation value that corresponds to a panel defect location, the panel defect location being where any one of a brightness and a color difference exists compared to other part of a display panel under same conditions;

a compensating unit to adjust image data to be displayed in the panel defect location using the compensation value, wherein the compensation unit includes:

an interface circuit communicating between the compensation unit and external system, a register storing the data transmitted through the interface circuit to update the memory, wherein the data are the pixel location data input from the external system and the compensation value supplied by user, a modulator reading the compensation value of each gray level at the location of the panel defect from the memory and generating the corrected data if the image data are to be supplied to the panel defect location, and wherein the compensation value increases or decreases a gray level of the image data to be displayed at the panel defect location, wherein the compensation value includes an R compensation value for compensating red data, a G compensation value for compensating green data, and a B compensation value for compensating blue data, wherein the compensation value further includes a W compensation value for compensating white data, and wherein only the W compensation value is set to adjust the image data to be displayed in the panel defect location.

15. The driving circuit according to claim 14, wherein the R compensation value, the G compensation value, and the B compensation value are set to be the same value in the same panel defect location.

16. The driving circuit according to claim 14, wherein at least one of the R compensation value, the G compensation value, and the B compensation value is set to be different than the other compensation values in the same panel defect location.

17. The driving circuit according to claim 14, wherein at least one of the R compensation value, the G compensation value, and the B compensation value is set to be different than the other compensation values in the same panel defect location.

18. The driving circuit according to claim 14, wherein the memory is accessible by an external system to read or modify the compensation values stored in the memory.

19. The driving circuit according to claim 14, wherein the memory includes a non-volatile memory.

20. The driving circuit according to claim 19, wherein the non-volatile memory includes any one of an electrically erasable programmable read-only memory (EEPROM) and extended display identification data read-only memory (EDID ROM).

21. The driving circuit according to claim 14, wherein the compensation value is stored in a look-up table corresponding to the panel defect location.

22. The driving circuit according to claim 14, wherein the memory further includes monitor information data including at least one of a manufacturer identification information of the display device, physical characteristic information of the display device, and performance variable information of the display device.

* * * * *